US011168398B2

(12) United States Patent
Stremsdoerfer et al.

(10) Patent No.: US 11,168,398 B2
(45) Date of Patent: Nov. 9, 2021

(54) METHOD AND DEVICE FOR PRODUCING METAL PATTERNS ON A SUBSTRATE FOR DECORATIVE AND/OR FUNCTIONAL PURPOSES, MANUFACTURE OF OBJECTS INCORPORATING SAID PRODUCTION AND SET OF CONSUMABLES USED

(71) Applicant: Jet Metal Technologies, Champagne-au-Mont-d'Or (FR)

(72) Inventors: Samuel Stremsdoerfer, Dardilly (FR); Arnaud Jammes, Erome (FR); Edouard Mourier Des Gayets, Lyons (FR)

(73) Assignee: Jet Metal Technologies, Champagne-Au-Mont-D'or (FR)

( * ) Notice: Subject to any disclaimer, the term of this patent is extended or adjusted under 35 U.S.C. 154(b) by 0 days.

(21) Appl. No.: 15/549,747

(22) PCT Filed: Feb. 12, 2016

(86) PCT No.: PCT/FR2016/050335
§ 371 (c)(1),
(2) Date: Aug. 9, 2017

(87) PCT Pub. No.: WO2016/128695
PCT Pub. Date: Aug. 18, 2016

(65) Prior Publication Data

US 2018/0030599 A1 Feb. 1, 2018

(30) Foreign Application Priority Data

Feb. 12, 2015 (FR) ..... 1551169

(51) Int. Cl.
*C23C 18/16* (2006.01)
*C25D 5/02* (2006.01)
(Continued)

(52) U.S. Cl.
CPC ..... *C23C 18/1605* (2013.01); *C23C 18/1655* (2013.01); *C23C 18/1689* (2013.01);
(Continued)

(58) Field of Classification Search
CPC ..... C23C 18/1605; C23C 18/1851; C23C 18/1655; C23C 18/1689; C23C 18/30;
(Continued)

(56) References Cited

U.S. PATENT DOCUMENTS 3,514,378 A * 5/1970 Lindell ..... C25D 1/003 427/123
3,625,758 A * 12/1971 Stahl ..... C23C 18/405 174/256

(Continued)

FOREIGN PATENT DOCUMENTS

EP 2318564 5/2011
EP 2326747 6/2011

(Continued)

*Primary Examiner* — Nathan H Empie
(74) *Attorney, Agent, or Firm* — James C. Lydon

(57) ABSTRACT

A method for producing metal patterns, which includes depositing a temporary protection on a substrate surface corresponding to the negative of the patterns to be produced; depositing at least one metal on the areas corresponding to the patterns to be produced; and eliminating the temporary protection at least partly during and/or after, or at least partly during and/or after the deposition step. The method can produce decorative objects or functional objects such as printed circuits, integrated circuits, RFID chips, and electronic reader-readable encoding pictograms. A set of consumables used to implement the method is also disclosed.

11 Claims, 5 Drawing Sheets

(51) Int. Cl.

| | |
|---|---|
| ***C23C 18/30*** | (2006.01) |
| ***C23C 18/20*** | (2006.01) |
| ***C23C 18/18*** | (2006.01) |
| ***C23C 18/42*** | (2006.01) |
| ***C25D 3/38*** | (2006.01) |
| ***C25D 5/48*** | (2006.01) |
| ***C25D 5/56*** | (2006.01) |

(52) U.S. Cl.
CPC ..... *C23C 18/1851* (2013.01); *C23C 18/206* (2013.01); *C23C 18/30* (2013.01); *C23C 18/42* (2013.01); *C25D 3/38* (2013.01); *C25D 5/022* (2013.01); *C25D 5/48* (2013.01); *C25D 5/56* (2013.01)

(58) Field of Classification Search
CPC ..... C23C 18/42; C25D 3/38; C25D 5/022; C25D 5/56; C25D 5/48
See application file for complete search history.

(56) References Cited

U.S. PATENT DOCUMENTS 4,699,811 A 10/1987 Kunces
5,268,255 A * 12/1993 Kikuchi ..... C08F 283/10 430/280.1
7,320,942 B2 * 1/2008 Chen ..... H01L 21/02071 257/E21.256
9,284,645 B2 3/2016 Stremsdoerfer
2005/0230805 A1 * 10/2005 Miyazawa ..... H01L 21/76898 257/690
2010/0075053 A1 * 3/2010 Stremsdoerfer .... C23C 18/1617 427/299
2011/0226629 A1 9/2011 Stremsdoerfer et al.
2015/0225570 A1 8/2015 Konishi et al.

FOREIGN PATENT DOCUMENTS

FR 2763962 12/1998
JP 48-17826 B 6/1973
JP 50-50668 A 5/1975
JP S51125635 11/1976
JP 55-158696 A 12/1980
JP 59129766 A * 7/1984 ..... H05K 3/184
JP S59129766 7/1984
JP 03123675 A * 5/1991
JP 10-190216 A 7/1998
JP 10190216 A * 7/1998
WO 2014038325 3/2014

* cited by examiner

METHOD AND DEVICE FOR PRODUCING METAL PATTERNS ON A SUBSTRATE FOR DECORATIVE AND/OR FUNCTIONAL PURPOSES, MANUFACTURE OF OBJECTS INCORPORATING SAID PRODUCTION AND SET OF CONSUMABLES USED

TECHNICAL FIELD

The technical field of the invention is that of fee surface coating of substrates, by single- or multi-layer metallic films.

The present invention relates to methods for the metallization of substrates for decoration, for example that can be applied to hollow glass articles, the manufacture of small bottles, cosmetics items, aeronautical, automotive and home automation components. The present invention also relates to metallization for functional purposes, for example for the manufacture of substrates for electronics, in particular for printed circuits, integrated circuits on a semi-conductor substrate, radio frequency identification (RFID) chips, coding icons that can be read by electronic readers, etc. In some cases, this metallization can be similar to printing.

In general, the substrates that are more specifically concerned by metallization are materials of all kinds, in particular non-conductors such as glass, plastic materials (polyolefins-polypropylene-, polycarbonates, polyesters, styrenes-Acrylonitrile-Butadiene-Styrene-) ceramics, wood, textiles, minerals, plaster or cement articles, semiconductors, conductors.

TECHNOLOGICAL BACKGROUND

Conventionally, two broad types of processes are distinguished for surface metallization of substrates; electrolytic metallization processes and non-electrolytic metallization processes.

Electrolytic metallization processes, also called galvanoplasty processes, are based on a redox reaction using an electric current. The metal is provided in cationic form in an aqueous medium. An electric current is applied between the substrate that it is desired to metallize and a counter-electrode. The metallic cation is then reduced at the surface of the substrate. One of the major drawbacks of electrolytic deposition is that the substrate that it is desired to metallize must necessarily be a conductor. Therefore this type of metallization is not possible for substrates of polymer, glass, etc.

The non-electrolytic metallization processes do not use an electric current. The metal is deposited by other means, by a dry route or by a wet route. Among the processes called "dry route", PVD (Physical Vapor Deposition) and CVD (Chemical Vapor Deposition) may be mentioned, which have as a major drawback the requirement to place the substrate tinder vacuum in order to carry out the metallization.

The processes called "wet route", which are technologically simpler to implement, are more widespread, and among them may be mentioned in particular, non-electrolytic metallization by immersion called "electroless method".

In a non-electrolytic metallization process by immersion the metal is also provided in cationic form in an aqueous medium. A reducing agent is also present in the medium, as well as generally, a complexing agent. The bath is prepared in such a way that although the metallic salt and the reducing agent are both present is the bath, the direct redox reaction is prevented. The latter is only possible in the presence of a catalyst. This is why the surface of the substrate that it is desired to metallize is treated beforehand with sensitizing and optionally activating agents which will render the surface catalytic. In the presence of the catalytic surface, the metallic salts are reduced by direction reaction with the reducing agent present in the medium.

This technique for non-electrolytic metallization by immersion is conventionally used in the surface treatments industry.

Here again, numerous drawbacks are to be noted, in particular:

- plating solutions can be unstable, and the metallic salt can precipitate before the introduction of the substrate.
- the deposition kinetics are slow.
- the use of chemical catalysts is expensive.
- the treatment ranges comprise numerous steps.
- regular maintenance of the solutions is required.
- it is difficult to carry out simultaneous deposition of several metals.
- adhesion of the metallic deposit to the substrate is weak, which renders the deposit very fragile.

These non-electrolytic metallization processes by wet route have undergone a recent technological advance, based on the principle of aerosol spraying. This is the "Jet Metal®" process, developed and improved by the applicant, in which one or more aqueous redox solutions are sprayed onto the substrate to be metallized, in the form of aerosols. The metal, present in the form of a metallic salt in solution, is then brought into contact with a reducing agent and it is immediately deposited directly onto the substrate. The metallic film obtained at the end of a metallization according to the "Jet Metal®" process is thus formed by the metal atoms deposited. This deposit can be rinsed then dried conventionally. No heat treatment is necessary in order to obtain a homogeneous and continuous metallic deposit on the substrate.

This "Jet Metal®" aerosol metallization process is described in particular in documents FR2763962B1, EP2326747B1, EP2318564B1. It has noticeable advantages with respect to the other existing non-electrolytic metallization processes. Jet Metal® makes it possible in particular to obtain substrates metallized with a homogeneous and continuous film, on an industrial, scale, in a pollution-free, or almost pollution-free, manner, at ambient temperature and atmospheric pressure.

Furthermore, several techniques are known for affixing metal patterns on substrates for decorative or functional purposes (printed circuits, RFID antennas, etc.).

These techniques are:

- either additive (deposition of metal): silver-based ink printing, temporary masking;
- or subtractive (etching of metal already present); photo-etching (photolithography), laser etching.

Additive Techniques:

In silver-based ink printing, conductive patterns are produced by direct printing (screen printing or inkjet printing), using inks filled with silver particles. A heat treatment is necessary in order to evacuate the solvent contained in the inks and to obtain a conductive pattern. The electrical conductivity of the patterns formed in this way is poorer than that of a continuous metallic film obtained by the other metallic deposition techniques.

The temporary masking consists of applying a mask (adhesives, peel-off coatings, stencils, etc.) to a surface to be protected so as to prevent the metallization of some areas; this technique is difficult to apply for obtaining complex patterns and requires a mechanical action that is not very compatible with mass production.

Subtractive Techniques:

Photoetching is widely used in the electronics industry for the production of printed circuits. The base substrate is constituted by an assembly comprising a layer of copper over an epoxy/glass fibre layer. The copper is covered with a photosensitive resin ("photoresist") which is exposed to light through a typon (printed mask with patterns): this is the exposure step. The exposed resin is polymerized under the effect of light. A suitable development solution is then used for solubilizing the non-polymerized resin. A chemical etching solution is then applied for attacking the copper that is not protected by the polymerized resin (etching step). Finally, the substrate is placed in contact with an extraction solution, so as to eliminate any trace of polymerized resin (stripping step), (see the attached FIG. 1).

Laser etching consists of using a laser for selectively extracting the metal that is already present on a substrate. Although very accurate, this process may prove expensive and difficult to implement for extensive patterns.

It is thus clear that there is currently a need for an industrial surface treatment technique that makes it possible to durably deposit metal patterns that are capable of being fine, accurate and complex (arabesques, tracery, calligraphy, etc.), both in the plane of the substrate surface coated with said patterns, and within the thickness of said patterns.

Technical Problem—Objectives of the Invention

One of the technical problems on which the present invention is based is to remedy this lack in the prior art.

The aim of the present invention is therefore to satisfy at least one of the following objectives:

The improvement sought are situated in particular in at least one of the following fields:

- providing a process for producing metal patterns that are capable of being fine, accurate and complex on any type of substrates, which can easily be productionized and automated;
- providing a process for producing metal patterns that are capable of being fine, accurate and complex on any type of substrates, which is simple to implement;
- providing a process for producing metal patterns that are capable of being fine, accurate and complex on any type of substrates, which is economical;
- providing a process for producing metal patterns that are capable of being fine, accurate and complex on any type of substrates, which is capable of use in-line without down time between each step and capable of incorporation into conventional coating lines.
- providing a process for producing metal patterns that are capable of being fine, accurate and complex on any type of substrates, which results in metal patterns that adhere perfectly and durably to the substrate;
- providing a process for producing metal patterns that are capable of being fine, accurate and complex on any type of substrates, which results in metal patterns that are homogeneous and regular as regards their surface and their thickness;
- providing a process for producing metal patterns that are capable of being fine, accurate and complex on any type of substrates, which results in metal patterns that are sufficiently thick, in particular for electrically conductive applications;
- providing a process for producing metal patterns that are capable of being fine, accurate and complex on any type of substrates, which results in metal patterns that are hard and resistant to all types of attack;
- providing a process for producing metal patterns that are capable of being fine, accurate and complex on any type of substrates, the consumables of which are based on materials that are common, simple and inexpensive, the formulation of which is easy to implement;
- providing a process for producing metal patterns that are capable of being fine, accurate and complex on any type of substrates, which is "clean" or eco-compatible, i.e. using solutions that are not toxic, or only slightly toxic or in very small quantities, and allowing recycling of the effluents originating from the process;
- providing a process for producing metal patterns that are capable of being fine, accurate and complex on any type of substrates, which makes it possible to produce decorative metal patterns (mirror effect of the patterns) on flat or 3D items;
- providing a process for producing metal patterns that are capable of being fine, accurate and complex on any type of substrates, which provides flexibility to the industrial installations implementing it; simplified installations, manufacturing steps that are dispensed with, increased productivity, etc.;
- providing a process for producing metal patterns that are capable of being fine, accurate and complex on any type of substrates, which makes it possible to obtain varied metal patterns (silver, copper, nickel, etc.) in-line in conventional industrial coating and/or wet metallization installations;
- providing an industrial device that is economical and high-performance for implementing the process as considered in at least one of the above objectives;
- providing a (set of) consumable(s) that is(are) economical and high-performance, capable of use in the process as considered in at least one of the above objectives;

BRIEF DESCRIPTION OF THE INVENTION

All or part of the aforementioned objectives is achieved by the present invention which relates, in the first of its aspects, to a process for the production of metal patterns on a substrate, characterized in that it essentially comprises the following steps:

A. optionally preparing the surface of the substrate intended to receive the metal patterns;

B. depositing a temporary protection on the surface of the substrate corresponding to the negative of the patterns to be produced by means of a screen printing mask/stencil of which use cut-outs correspond to the negative of the patterns to be produced; and/or by direct printing, preferably by ink jet;

C. optionally activating the surface of the substrate, in particular the areas corresponding to the patterns to be produced;

D. metallizing the substrate by depositing at least one metal, in particular on the areas corresponding to the patterns to be produced;

E. eliminating the temporary protection of step B;

F. optionally rinsing the surface of the substrate carrying the metal patterns;

G. optionally drying the surface of the substrate carrying the metal patterns;

H. optionally applying a finishing treatment to the surface of the substrate carrying the metal patterns;

and in that step E of eliminating the temporary protection is carried out, during step D, or at least partly during step D, and/or after step D, or at least partly during and/or after the metallization step D and partly before the metallization step D.

It is to the inventors' credit to have developed this selective metallization technique capable of being used in-line which relies in particular on the use of a temporary protection on certain areas of the surface of the substrate which form the negative of the revised metallization patterns. A feature of this temporary protection is the ability to be removed easily and cleanly from the surface of the substrate intended to receive the metal patterns, so that the fineness and accuracy of the metal patterns, even when complex, are not damaged daring this removal operation. In particular, the inventors propose removal of the temporary protection, in particular by a non-mechanical means, for example by dissolution in a solvent used in a later phase of the process, at least partly during or in the course of the process for producing the metal patterns and/or after this metallization D, or at least partly during and/or after the metallization step D and partly before the metallization step D.

In practice, the elimination E of the temporary protection can be earned out entirely during the metallization. In this ease, the duration of this elimination E is less than or equal to the duration of the metallization D.

According to aa alternative, this elimination E takes place partly during the metallization D and partly after and/or before this metallization D.

According to another alternative, this elimination E takes place partly before and partly after this metallization D.

According to another alternative, this elimination E takes place entirely after this metallization D.

In particular, this process has the following advantages:

i) it gives access to decorative and/or functional metal patterns that have complex shapes, in particular very fine written elements;

ii) it is compatible with the industrial productivity and quality requirements, in particular in terms of hardness and adhesion to the substrate;

iii) it is simple to implement and it is economical;

iv) it is applicable to a multiplicity of substrates, conductive or non-conductive;

v) the spectrum of the metals or alloys that can be deposited is very broad;

vi) the consumables, in particular the solutions, used are stable;

vii) the fineness of the patterns and the thickness of the deposit can easily be controlled;

viii) it is possible to produce alloys or composite metal patterns.

According to a noteworthy feature of the invention, step E essentially consists of at least one of the following operations:

dissolution of the temporary protection by at least one solvent utilized in the process, said temporary protection preferably being alkali-soluble so that it can be dissolved to an alkaline solvent implemented in the process.

entrainment in liquid phase;

mechanical entrainment by a gas, preferably air.

According to a first mode of implementation, the metallic deposition D is a non-electrolytic metallization by spraying of one or more redox solutions in the form of (an) aerosol(s). Moreover, this first mode of implementation optionally comprises, before the metallization D, at least one of the following steps, preferably in the following order:

I. treatment increasing the surface energy of the substrate, in the knowledge that in the event that the process comprises an activating step C, a step I of increasing the surface energy of the substrate can optionally be provided before the activation C.

J. wetting the surface of the substrate;

K. rinsing the surface of the substrate.

Preferably, the metal of step D is selected from the following group of metals: silver, nickel, copper, tin, iron, gold, cobalt, oxides, alloys and combinations thereof.

In the event that the process comprises a step A of preparation of the surface of the substrate intended to receive the metal patterns, said step A comprises the deposition of at least one layer of varnish and/or the degreasing of said surface. Advantageously, the varnish deposited can be constituted by at least one heat-cross-linked organic layer containing or not containing pigments/colorants (for example a polyurethane, such as that presented in the form of water-soluble powder) and/or under exposure by actinic radiation, for example UV.

The optional treatment for increasing the surface energy of the substrate according to step 1, which can be incorporated into a step A of surface preparation of the substrate, is selected from the physical treatments, preferably the following physical treatments: a flame treatment, a plasma treatment and combinations thereof, and/or chemical treatments, preferably the following chemical treatments: application of a silane-based solution, depassivation of the surface using one or more acid solutions, polishing based on a rare-earth oxide, fluorination and combinations thereof.

According to a second mode of implementation, the metallic deposition D is an autocatalytic chemical metallization (of the electroless type) or metallization by displacement, by immersion in one (or more) suitable metallization solution(s) and in that it comprises an activation C and optionally, before the activation C, at least one of the following steps, preferably in the following order:

L. satin etching, preferably implemented between step B and step C;

M. rinsing the surface of the substrate in the case of satin etching according to step L.

According to a third mode of implementation, the substrate is a conductive material per se or treated in order to become so (i.e. rendered conductive beforehand by the techniques of art) and the metallic deposition D is an electrolytic metallization.

According to a beneficial embodiment of the invention, the metallization process to which it relates can include the first mode and/or the second mode and/or the third mode of implementation mentioned above.

According to a preferred feature of the invention, the solvent allowing the dissolution of the temporary protection is contained in at least one of the liquids utilized for the metallization step D and/or optionally in the liquids used in at least one rinsing step and in that the duration of this metallization step D is unlimited and, preferably, is less than or equal to the duration of dissolution of the temporary protection.

Advantageously, the metal patterns obtained are decorative and/or functional, and are preferably included in the group comprising—preferably constituted by: printed circuits, integrated circuits on a semiconductor substrate, radio frequency identification (RFID) chips, coding icons capable of being read by electronic devices, representational and/or written information identifying a product, in particular a commercial product, such as a decorative visual representation or design on a cosmetic and/or automotive product.

According to a noteworthy feature of the invention, the process according to the invention is implemented continuously/in-line on industrial plant, for example for lacquering and/or wet metallization.

According to a second aspect, the present invention relates to a process for the manufacture of objects comprising metal patterns, preferably decorative and/or functional, characterized in that it implements the process according to at least one of the preceding claims.

According to a third aspect, the present invention relates to a device for implementing the process according to the invention, characterized in that it comprises:

i. a module for depositing a temporary protection on the surface of the substrate;
ii. a metallization module;
iii. optionally a module for producing a top coat, and/or;
iv. optionally a module for preparing the surface of the substrate intended to receive the metal patterns; and/or;
v. optionally at least one screen printing mask/stencil useful in one of the variants of step B; and/or;
vi. optionally a module for activating the surface of the substrate of step C; and/or;
vii. optionally a module for eliminating, according to step E, the temporary protection of step B; and/or;
viii. optionally a module for rinsing according to step F; and/or;
ix. optionally a module for depositing at least one top coat according to step H.

According to an advantageous embodiment, this device can be in-line in industrial installations, for example on a lacquering and/or wet metallization line.

According to a fourth aspect, the present invention relates to a set of consumables for implementing the process according to the invention, characterized in that it comprises:

a. (a) consumables) for carrying out the temporary protection of step B;
b. (a) consumable(s) for the metallization of step D;
c. optionally, (a) consumable(s) for preparing the surface of the substrate intended to receive the metal patterns of step A; and/or;
d. optionally at least one screen printing mask/stencil useful in one of the variants of step B; and/or;
e. optionally (a) consumable(s) for activating the surface of the substrate of step C; and/or;
f. optionally (a) consumable(s) for eliminating, according to step E, the temporary protection of step B; and/or;
g. optionally (a) consumable(s) for ringing according to step F; and/or;
h. optionally (a) consumable(s) for depositing at least one top coat according to step H.

Definitions

Throughout the present disclosure, the singular denotes either singular or plural.

The definitions given hereinafter by way of example can be used for the interpretation of the present disclosure.

By "aerosol" is meant that e.g. a mist of droplets of a size less than 100 μm, preferably less than 60 μm, and even more preferably from 0.1 to 50 μm, produced by nebulization and/or atomization of (a) solution(s) and/or (a) dispersion(s) is concerned.

The term "non-electrolytic metallization" relates in particular to the process described in FR2763962B1, EP2326747B1, or EP2318564B1.

BRIEF DESCRIPTION OF THE DRAWINGS:

The invention will be better understood on reading the following description of examples of the manufacture of metal patterns on different supports, with reference to the attached drawings, in which.

DETAILED DESCRIPTION OF THE INVENTION

Substrates

Figure 1:
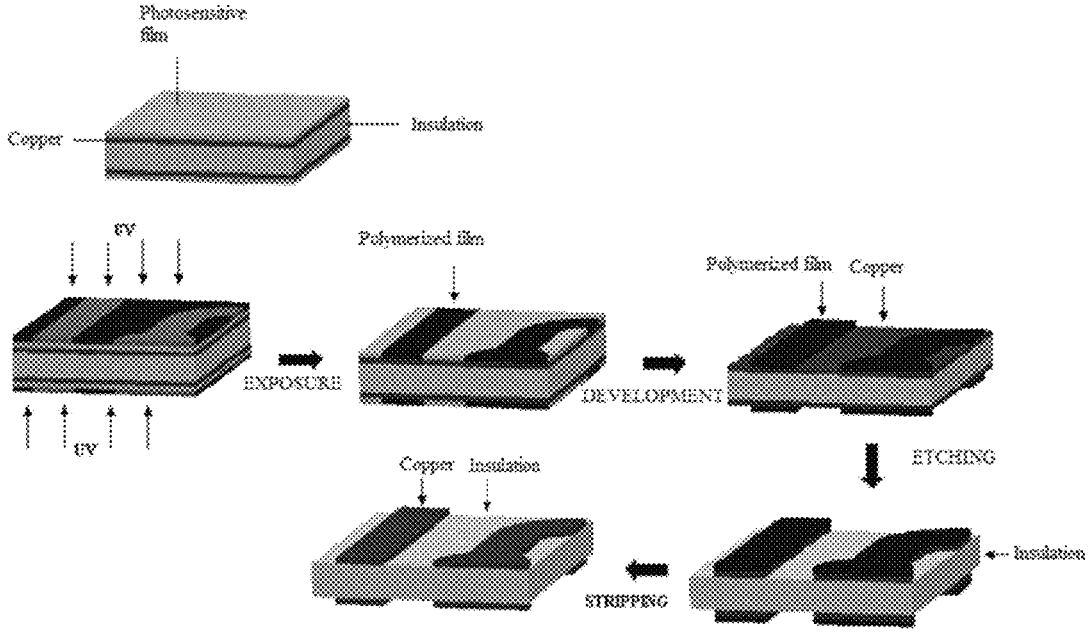
FIG. 1 shows a diagram illustrating the known photolithography processes for the manufacture of printed circuits.
Figure 2:
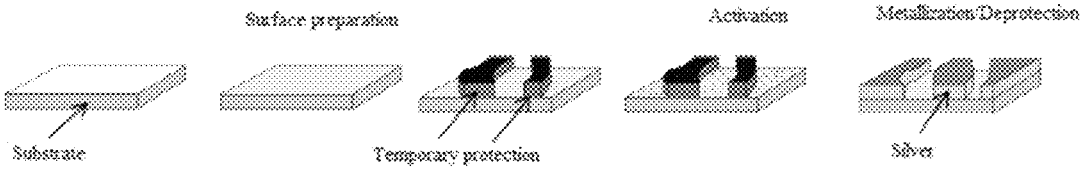
FIG. 2 shows a diagram illustrating the protocol of Examples 1 and 2 implementing the process according to the invention with a metallization by aerosol spraying.

The substrate can be a non-conductive material, a semiconductor material or a conductive material.

In the case where a non-conductive material is concerned, this can be selected from the group comprising, or ideally constituted by: glass, plastic/(co)polymer materials (polyolefins-polypropylene-, polycarbonates, polyesters, styrenes-Acrylonitrile-Butadiene-Styrene-), composite materials, ceramics, textiles, wood, minerals, plaster or cement articles.

If a conductive material is envisaged as substrate, this can be a metal.

The semiconductor material capable of being a substrate is one of those commonly used in the semiconductor industry.

Under certain conditions of implementation of the process described herein, the substrate is a rigid substrate, conductive or non-conductive as defined above. Rigid hollow glass substrates and rigid polymer substrates are particularly preferred.

Within the meaning of the invention, a hollow glass substrate is a substrate of non-planar glass, in particular a glass container such as a glass flask or bottle.

Under other preferred conditions of implementation of the process of the invention, the substrate is a flexible substrate. It is for example selected from the following compounds: polymers, metals, textiles, sheet metals and paper. Preferably, the flexible substrate is a textile or a polymer film. For example, the flexible substrate is a polyester film the thickness of which is from 100 μm to 5 mm, a fabric or a paper sheet the density of which is from 50 à 600 g/m$^2$.

In the present disclosure, by "flexible substrate" is meant a substrate that can be bent or folded by human force alone without breaking or damage.

Conversely, by "rigid substrate" is meant a substrate that cannot be bent or folded by human force alone without breaking or damage.

Step A: Preparing the Surface of the Substrate Intended to Receive the Metal Patterns This surface preparation step can take place before or after the application of the temporary protection.

In certain cases, preparation of the substrate before application of the temporary protection makes it possible to avoid subjecting this layer to physico-chemical modifications, which could lead to it becoming fixed on the substrate, making elimination (preferably solubilization) of the temporary protection more difficult.

In other cases, the surface preparation can take place deliberately after application of the temporary protection, with a view to reinforcing its cohesion and slowing down its elimination (preferably solubilization).

Such preparation can comprise cleaning/degreasing of the surface, by means of any suitable products that are known per se.

In addition to, or instead of, this cleaning/degreasing, it is possible to deposit a varnish on the surface of the substrate, for example a UV-cross-linked varnish applied by spraying, by any suitable known means such as a compressed-air spray gun (e.g. HVLP: high volume low pressure).

According to a variant, step A can include at least one treatment for increasing the surface energy (step 1).

Step B: Depositing a Temporary Protection on the Surface of the Substrate Corresponding to the Negative of the Patterns to be Produced

Temporary Protection

According to a noteworthy arrangement of the invention, this temporary protection is a coating corresponding to the negative of the desired patterns. This coating is obtained from a liquid product that dries and/or hardens once applied onto the surface of the substrate and/or that is cross-linked under actinic radiation, for example UV.

This liquid product has the feature of being soluble in at least one of the solvents utilized later in the process according to the invention. In particular, this can be a product that is soluble in an alkaline solvent.

This temporary protection product can comprise for example an ink and/or any other organic product having a high solubility in a suitable solvent.

According to a variant, the liquid product utilized for producing the protective coating can be a product that gives rise, after drying and/or hardening and/or cross-linking under actinic radiation, for example UV, to a coating the adhesion to the substrate of which can be reduced by at least one of the—preferably liquid—substances, in particular the solvents, utilized later in the process according to the invention. By way of example of such a protection product, alkaline-sensitive inks may be mentioned.

Of course, it is not necessary for the ink to be pigmented as in conventional printing. However, an ink containing a colorant allows the temporary protection applied to the surface of the substrate to be visible, which can prove practical.

B.1: Deposition of the temporary protection can be carried out via any known application technique, for example by means of a screen printing mask/stencil, offset, flexography, pad-printing or any other transfer technology.

The screen printing mask/stencil is for example manufactured from a substance constituted by a polymer material and known conventionally to a person skilled in the art.

B.2: In another case, deposition of the temporary protection material can be carried out by a technique allowing a fine, accurate and clear print on a substrate. Inkjet printing or deposition by a stylus containing a suitable ink are examples fulfilling this requirement.

Step C: Activating the Surface of the Substrate, in Particular the Areas Corresponding to the Patterns to be Produced Step C.1: When step D is a non-electrolytic metallization by spraying one or more redox solutions in aerosol form, the activation C is necessary for some metals. It is intended to accelerate the redox reaction taking place in this step D.

During this step C, at least one sensitizing chemical species is adsorbed on the surface of the material and thus accelerates the metallization reaction.

If the temporary protection is present, as is preferably the case, the one or more sensitizing chemical species is(are) adsorbed on the unprotected substrate and on the protection layer.

In order to carry out this step C, a sensitizing solution will preferably be applied by spraying onto the surface of the substrate, preferably coated with the temporary protection. This spraying is carried out by any suitable known means such as a compressed-air spray gun (e.g. HVLP: high volume low pressure). According to a variant, this can be an immersion.

For example, a first sensitizing solution based on stannous chloride ($SnCl_2$) or $SnSO_4/H_2SO_4$/quinol/alcohol, is applied by spraying or immersion. A solution of palladium or silver capable of reacting with the $Sn^{2+}$ in order to form nucleation centres at the surface of the substrate, or a colloid solution of PdSn formed ex situ, is then deposited. For further details, reference may be made for example to "*Metal Finishing Guidebook and Directory Issue*", 1996 *Metal Finishing publication,* pages 354, 356 et 357. H. Narcus "*Metallizing of Plastics*", *Reinhold Publishing Corporation,* 1960, Chapter 2, page 21. F. Lowenheim, "*Modern electroplating*", *John Wiley & Sons publication,* 1974 Chapter 28, page 636.

Advantageously, the step of sensitizing the surface of the substrate is implemented by means of a sensitizing solution based on stannous chloride, for example according to the mode of implementation described in FR-A-2 763 962. In this case, a step of rinsing using a rinsing liquid such as that described below is carried out straight after the sensitizing step, with no intermediate step.

According to a variant, activating the surface of the substrate is implemented by means of a sensitizing solution, in particular palladium chloride, for example according to the mode of implementation described in FR2763962B1. In this case, a step of rinsing using a rinsing liquid such as that described in the examples hereinafter is carried out straight after the activating step, with no intermediate step.

C.2: When step D is a chemical metallization (called "electroless") without an electric current/auto-catalytic, by immersion in one (or more) suitable metallization solution (s), the activation C which is intended to accelerate the catalytic redox reaction taking place in this step D, is generally essential.

It consists of depositing on the surface of the substrate, coated with the temporary protection, a chemical metallization catalyst without current, for example a catalyst of the Sn/Pd type. The catalyst is adsorbed over the entire surface of the substrate (unprotected areas corresponding to the patterns to be affixed and temporary protection layer).

This activation C is preferably preceded by a step L (satin-etching) followed by a step M (rinsing).

Step L

This satin-etching step is in fact a treatment for increasing the surface energy of the substrate and/or for increasing the roughness of the substrate, capable of being of the type defined below for step I.

In the case of metallization without current, satin-etching is preferably carried out by physical treatment (Corona discharge, plasma treatment) or chemical treatment (e.g.

sulphur-chrome treatment or other) in order to give sufficient adhesion to the metal patterns to be deposited.

Step M

This is a rinsing of the type defined below for step K.

Step D: Metallization

D.1: Metallization by Aerosol Spraying

The following steps: step I. (treatment for increasing the surface energy of the substrate), step J (wetting the surface of the substrate) and step K (rinsing the surface of the substrate), which can precede step C or step D, are described hereinafter, prior to the description of D1.

Step 1

The treatment for increasing the surface energy of the substrate according to step I is selected from physical treatments, preferably the following physical treatments: a flame treatment, a plasma treatment and combinations thereof, and/or chemical treatments, preferably the following chemical treatments; application of a silane-based solution, depassivation of the surface using one or more acid solutions, polishing based on a rare-earth oxide, fluorination and combinations thereof.

Preferably, the physical treatment of step I is a flame treatment.

Moreover, the physical treatment is advantageously a flame and/or plasma treatment, when the substrate is a rigid substrate made from plastic material, composite material, polymer or a flexible support made from polymer, metal such as metal sheet, textile or paper.

Flame treatment is, for example, passing the substrate to be metallized under a flame the temperature of which is from 1200° C. to 1700° C. The duration of flame treatment is generally from 4 to 50 seconds. The flame is preferably obtained by combustion of a fuel such as propane gas (or town gas) in the presence of an oxidizer such as oxygen.

The plasma treatment corresponds for example to passing the substrate to be metallized through a plasma torch, for example those marketed by ACXYS® or PLASMA-TREAT®.

In step 1, the chemical treatment is preferably selected from the following treatments: application of a silane-based solution, passivation of the surface using one or more acid solutions, polishing based on a rare-earth oxide, fluorination and combinations thereof.

Even more preferably, the chemical treatment is an application of a silane-based solution, passivation by discharge of one or more acid solutions, fluorination and combinations thereof.

Moreover, this chemical treatment is more specifically implemented when the substrate is a rigid substrate of hollow glass, metal or alloy.

Passivation means for example that the surface of the substrate is corroded until the layer of oxide covering it is eliminated, by the action of a corrosive substance sprayed onto the substrate, such as a strong acid solution, for example based on nitric, citric, sulphuric acid and mixtures thereof.

"Polishing based on a rare-earth oxide" means for example that a solution based on a rare-earth oxide is applied onto the substrate to be metallized and that pads polish the surface of the substrate, in particular by rubbing against its surface, until elimination of any oxide layer present on the surface is obtained and the latter is smoothed. Preferably, the solution based on a rare-earth oxide is a solution based on cerium oxide, which is for example of the type marketed by the company POLIR-MALIN® under the name GLASS POLISHING®. Preferably, the polishing based on a rare-earth oxide comprises a step of rinsing the surface polished in this way, in particular with distilled water.

Fluorination corresponds for example to placing the substrate to be metallized in contact, in an enclosure under reduced pressure, with a gaseous solution based on inert gas (argon) containing a fluorinated additive. According to the invention, fluoridation is carried out for example with an apparatus of the type marketed by AIR LIQUIDE®.

These physical or chemical treatments for increasing the surface energy of the substrate must be carried out so that the surface energy of the substrate is greater than or equal to 50 or 55 dynes, preferably greater than, or equal to 60 or 65 dynes, and even more preferably greater than or equal to 79 dynes. Below these values, the wetting of the substrate is insufficient and the metallic coating obtained after metallization has unsatisfactory adhesion, gloss and reflectivity characteristics. The value for the surface energy can be measured for example by techniques known to a person skilled in the art consisting of applying a specific solution onto the substrate, using a brush or felt, and measuring the retraction time of the solution applied in this way.

Step J

The wetting step J consists of coating the surface of the substrate with a liquid film in order to promote spreading of the redox solutions. The wetting liquid is selected from the following group: water, deionized or not, optionally with the addition of one or more anionic, cationic or neutral surfactants, an alcohol solution comprising one or more alcohols (for example isopropanol, ethanol and mixture thereof), and mixtures thereof. In particular, as wetting liquid, deionized water will be selected, to which an anionic surfactant and alcohol have been added. In a wetting variant according to which the wetting liquid is converted into vapour that is sprayed onto the substrate on which they condense, it is preferable for the liquid to be essentially aqueous for obvious reasons of industrial suitability. The duration of wetting depends on the surface of the substrate in question and the flow rate of spraying of the wetting aerosol.

The wetting step can optionally be substituted for the step C of activating the substrate.

Step K

Advantageously, this rinsing step K, as with the other rinsing steps that mark the stages of the process, like step F or M, consist of bringing all or part of the surface of the substrate into contact with one or more source(s) of rinsing liquid, which are carried out at different stages of the process of the invention, are carried out by spraying an aerosol of rinsing liquid, preferably of demineralized water.

D.1 is a non-electrolytic metallization by aerosol spraying and relates in particular to the process described in FR2763962B1, EP2326747B1, or EP2318564B1.

The aerosol (or aerosols) is (are) e.g.:

either a single solution containing one or more oxidant(s) and one or more reducing agent(s) at once, or two solutions: the first containing one or more oxidant (s) and the second containing one or more reducing agent(s).

or a plurality of solutions, each being capable of containing either one or more oxidant(s) or one or more reducing agent(s), provided that there is at least one oxidant solution and at least one reducing agent solution.

The reducing agent is advantageously sufficiently strong to reduce the metallic cation to metal, i.e. the standard redox potential of the oxidant-reduction agent pair of the reducing agent must be less than that of the oxidant-reduction agent pair of the oxidant (gamma rule).

The oxidation/reduction solutions used during the non-electrolytic metallization step are sprayed in the form of aerosols onto the substrate and are preferably obtained from solutions, advantageously aqueous, of one or more oxidant metallic cations and one or more reducing compounds. These redox solutions are preferably obtained by dilution of concentrated stock solutions. The diluent is preferably demineralized water.

It follows that according to a preferred feature of the invention, the spraying of the aerosol(s) is carried out by nebulization and/or atomization of solution(s) and/or dispersion(s), so as to obtain a mist of droplets of a size less than 100 μm, preferably less than 60 μm, and even more preferably from 0.1 to 50 μm.

In the process according to the invention, the spraying of metallic solutions takes place preferably continuously and the substrate is moved and subjected to the spraying. For example, when the metallic deposit is based on silver, the spraying is preferably continuous. For a metallic deposition based on nickel for example, the spraying takes place preferably alternately with rest periods.

In the process of the invention, the spraying has a duration from 0.5 to 200 seconds, preferably from 1 to 50 seconds and even more preferably from 2 to 30 seconds for a surface to be metallized of 1 $dm^2$. The duration of spraying has an effect on the thickness of the metallic deposit and thus on the opacity of this deposit. For most metals, if the duration of spraying is less than 15 seconds, the deposit is classified as semi-transparent and if the duration of spraying is greater than 60 seconds, the deposit is classified as opaque. The substrate can be at least partially rotated during the metallization spraying.

According to a first spraying method, one or more solution(s) of metallic cations and one or more solution(s) of reducing agents are sprayed simultaneously onto the surface to be treated, in one or more aerosols, in a continuous manner. In the case in question, mixing of the oxidant solution and the reducing agent solution can be carried out just before the formation of the aerosol spray or also by merging an aerosol produced from the oxidant solution and an aerosol produced from the reducing agent solution, preferably before coming into contact with the surface of the substrate to be metallized.

According to a second spraying method, one or more solution(s) of metallic cations, then one or more solution(s) of reducing agent(s), are sprayed successively, via one or more aerosols. In other words, spraying of the redox solution is carried out by one or more separate spraying(s) of one or more solutions of one or more metallic oxidants and one or more solutions of one or more reducing agents. This second possibility corresponds to alternate spraying of the reducing agent solution(s) and the metallic salt(s).

Within the framework of the second spraying method, the combination of several oxidant metallic cations in order to form a multi-layer of different metals or alloys, is such that the different salts are preferably sprayed naturally separately from the reducing agent but also separately from each other and successively. It goes without saying that apart from the different nature of the metallic cations, it can be envisaged to use counter-ions that differ from one another.

According to a variant of the spraying step, arrangements are made for the mixture of the oxidant(s) and the reducing agent(s) to be metastable, and after spraying the mixture, the latter is activated so that the transformation to metal is triggered, preferably by bringing into contact with an initiator, advantageously provided via one or more aerosols, before, during or after spraying of the reaction mixture. This variant makes it possible to pro-mix the oxidant and the reducing agent while slowing their reaction until they cover the surface of the substrate after spraying. The initiation or activation of the reaction is then obtained by any suitable physical (temperature, UV, etc.) or chemical means.

Beyond the methodological considerations presented above and illustrated hereinafter in the examples, it is appropriate to give some more specific information concerning the products implemented in the process according to the invention.

Water appears to be the most suitable solvent, without however excluding the possibility of using organic solvents, for the production of the solutions from which the sprayed aerosols will be produced. The redox solutions to be sprayed during the step of metallization of the substrate are one or more solutions of a metallic oxidant and one or more solutions of a reducing agent.

The concentrations of metallic salts in the oxidant solution to be sprayed are from 0.1 g/l to 100 g/l and preferably from 1 to 60 g/l, and the concentrations of metallic salts of the stock solutions are from 0.5 g/l to 500 g/l, or the dilution factor of the stock solutions is from 5 to 5000. Advantageously, the metallic salts are selected from silver nitrate, nickel sulphate, copper sulphate, tin chloride, chloroauric acid, ferric chloride, cobalt chloride and mixtures thereof.

Selection of the reducing agents is preferably from the following compounds: borohydrides, dimethylaminoborane, hydrazine, sodium hypophosphite, formol, lithium aluminium hydride, reducing sugars such as the derivatives of glucose or sodium erythorbate and mixtures thereof. Selection of the reducing agent requires taking account of the pH and of the properties required for the metallization film. These routine adjustments are within the scope of a person skilled in the art. The concentrations of reducing agent in the reducing solution to be sprayed are from 0.1 g/l to 100 g/l and preferably from 1 to 60 g/l, and the concentrations of reducing agent of the stock solutions are from 0.5 g/l to 250 g/l, or the dilution factor of the stock solutions is from 5 to 2500.

According to a particular feature of the invention, particles are incorporated into at least one of the redox solutions in order to be sprayed at the time of metallization. The particles are thus trapped in the metallic deposit. These hard particles are for example diamond, ceramics, carbon nanotubes, metallic particles, rare-earth oxides, PTFE (polytetrafluoroethylene), graphite, metal oxides and mixtures thereof. The incorporation of these particles into the metallic film confers particular mechanical, tribological, electrical, functional and aesthetic properties on the metallized substrate.

D.2: Metallization by Immersion Without Current (Electroless)

It is possible for this step D to be preceded by at least one of the following steps: step L (satin-etching treatment of the surface of the substrate) and a step M (rinsing the surface of the substrate).

This step L is according to step I as described above in section D.1 relating to non-electrolytic metallization by the spraying of aerosols.

The same applies for rinsing tables M.

This metallization D.2 is preferably carried out by immersion of the substrate, preferably after elimination of the temporary protection, in as "electroless" bath containing oxidation species, reducing agents as well as stabilizers and surfactants.

During this step, metallization takes place on all the areas catalyzed by the adsorbed catalyst grains (e.g. Palladium). The surface protected by the temporary protection (preferably eliminated during step E) is not catalyzed and cannot therefore be the site of a metallization.

In the event that the temporary protection layer is not eliminated, it is advisable to implement a temporary protection on which the catalyst cannot be adsorbed and which is capable of withstanding the electroless bath, in order to avoid contamination thereof.

For further details on the metallization by immersion without current, reference may be made to the following examples as well as to numerous documents describing this technology, such as the literature on galvanoplasty.

D.3 : Electrolytic Metallization in the Ease Where the Substrate is a Conductive Material For further details on this metallization, reference may be made to the numerous documents describing this technology.

Step E: Eliminating the Temporary Protection

The elimination of the temporary protection can take place during, or at least partly during, and/or after the metallization step D, or partly during and/or after the metallization step D, and partly before the metallization step D. The elimination of the temporary protection at least partly during the metallization, assumes that the means utilized in the latter allow this, and that the residue produced by this elimination is not of a type that will interfere with the metallization. This is the case in particular for metallization by spraying of aerosols.

Elimination of the temporary protection after metallization may be used in the event that the metallization means, for example metallization solutions, are not capable of solubilizing the temporary protection, as in the metallization by spraying of aerosols with certain metals, for example nickel. According to a preferred mode of implementation of the invention, this elimination is a dissolution in a solvent used in the process.

According to another possibility of the invention, the process comprises a rinsing step F, and step E of eliminating the temporary protection is carried out partly during step D and at least partly during step F.

According to another possibility of the invention, the process comprises a drying step G, and step E of eliminating the temporary protection carried out partly during step D and at least partly during step G.

E.1: Metallization by Aerosol Spraying

In this mode of implementation, the elimination of the temporary protection can take place during the metallization step. In such a case, it is important that at least one of the metallization solutions comprises a solvent of the temporary protection.

In practice, and even more preferably, the temporary protection is alkali-soluble (e.g. ink) the metallization solutions have a strongly alkaline pH, which allows them to solubilize this temporary protection.

During the spraying of the metallization solutions, the unprotected areas are metallized while the protection layer is solubilized and evacuated in the effluents, thus allowing the metal patterns to appear.

It is preferable for the duration of metallization to be limited so as to avoid any possibility of metallization on the areas initially covered by the temporary protection.

In this mode of implementation, for the metals that do not need activating (e.g. nickel), it is possible to rinse, for example by spraying, the surface of the substrate comprising the metal patterns in question and the temporary protection itself covered with a layer of metal, using solvents of this temporary protection. Dissolution of the latter is accompanied by the evacuation of the metal layer with which it is covered.

E.2: Metallization by Immersion Without Current

Before the metallization, a suitable solution is therefore applied, i.e. containing a solvent of the temporary protection, onto the surface of the substrate. This can be carried out for example by immersion followed by rinsing. This dissolution reveals the areas of the surface of the substrate corresponding to the negative of the metal patterns to be produced As the deprotected areas of the surface are not activated (adsorption of the catalyst), they do not allow initiation of the metallization for a sufficient duration in order to form metal patterns. By sufficient duration is meant the duration necessary for the formation of the metal patterns on the activated areas of the surface of the substrate.

Step F: Rinsing

According to the invention, the rinsings which mark the separations between the different deposits involved in the process are carried out in a suitable known manner, for example by spraying/discharge of rinsing liquid or immersion in a rinsing liquid. The latter is advantageously and preferably water, and more particularly demineralized water.

Step G: Drying/Blowing

The drying or blowing, which can take place in particular after each rinsing step, consists of the evacuation of the rinsing water. It can advantageously be carried out at a temperature from 20 to 60° C. using for example a compressed air system pulsed at e.g. 5 bars/pulsed air, at a temperature from 20 to 60° C. Drying in the open air or in an oven can also be envisaged.

Step H: Finishing Treatment on the Surface of the Substrate Carrying the Metal Patterns In order to reinforce the protection of the metal patterns against aggressive external agents and/or in order to reinforce the electrical conductivity of the metal patterns, it can be provided according to the invention to follow the metallization ("post-metallization") with at least one metal identical to or different from the metal of the metallization step D, preferably by electrolytic thickening.

A variant finishing treatment can be depositing at least one top coat of a cross-linkable liquid composition on the surface of the substrate carrying the metal patterns. This cross-linkable liquid composition on the protection layer is for example a paint or a varnish, preferably a treating varnish. This varnish can have a water-soluble or organic base, preferably organic. It is selected from the paints of the following group: alkyds, polyurethanes, epoxies, vinyls, acrylics and mixtures thereof. Preferably, it is selected from the following compounds: epoxies, alkyds and acrylics and even more preferably, it is an alkyd varnish. The cross-linkable liquid finishing composition can be cross-linked by UV or thermal cooking and can contain pigments or colorants for colouring.

In the process according to the invention, the effluents originating from the different steps of the process are advantageously reprocessed and recycled in order to be reused in the process, and in order to reduce the ecological impact.

The advantages of the process according to the invention are numerous;

It relates to selective deposition of metal patterns capable of being fine and complex, on an industrial scale with high productivity, while allowing excellent adhesion and very high resistance of the metal patterns with respect to external attacks, over long periods of time.

The flexibility and the graphical, ornamental and functional possibilities provided by this process for producing metal patterns on any type of substrate are extremely significant.

Moreover, the process according to the invention gives access to new industrial processes:

for the decoration or metallized marking of objects with figurative or written identification information, and for the manufacture of functional elements in electronic devices such as printed circuits of integrated circuits on a semiconductor substrate, radio-frequency identification chips, coding icons that can be read by electronic readers, etc.

In this way, the invention thus provides these new advantageous industrial processes, incorporating the technique of selective deposition of metal patterns described and claimed herein.

EXAMPLE 1

Producing Metal (Silver) Patterns on a Varnished Plastic Substrate for Decoration Purposes -A-Surface Preparation:

A UV-cross-linking varnish reference VB330R developed by the company Jet Metal Technologies® is applied using a pneumatic HVLP gun with air pressure comprised between 3 and 4 bars onto an ABS (Acrylonitrile Butadiene Styrene) plate of dimensions 25 cm×20 cm, degreased beforehand.

The applied plate undergoes desolvation in an oven at 60° C. for 5 minutes before polymerization in a UV enclosure (0.7 to 1.2 J/cm$^2$ UVA).

Figure 3:
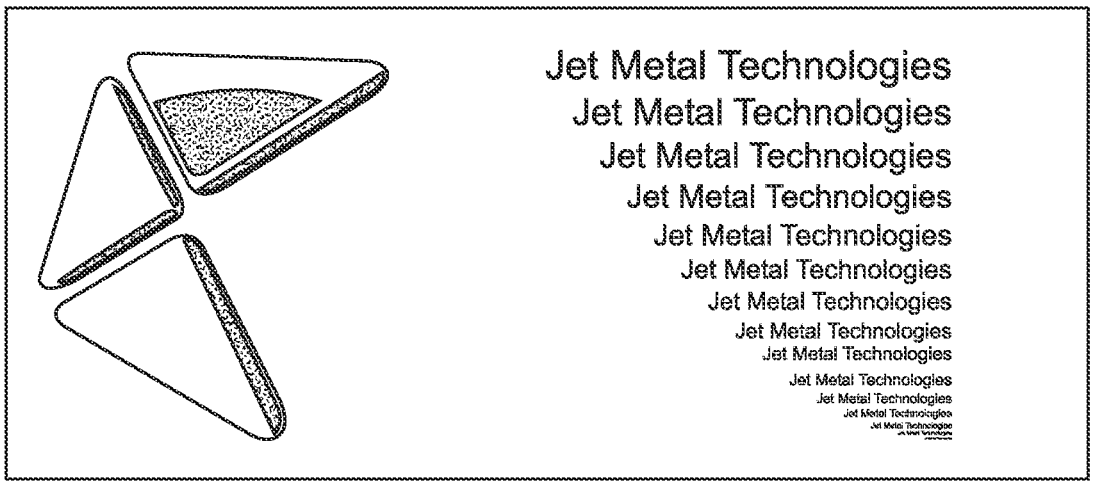
FIG. 3 shows the screen printing mask of Example 1.
Figure 3:
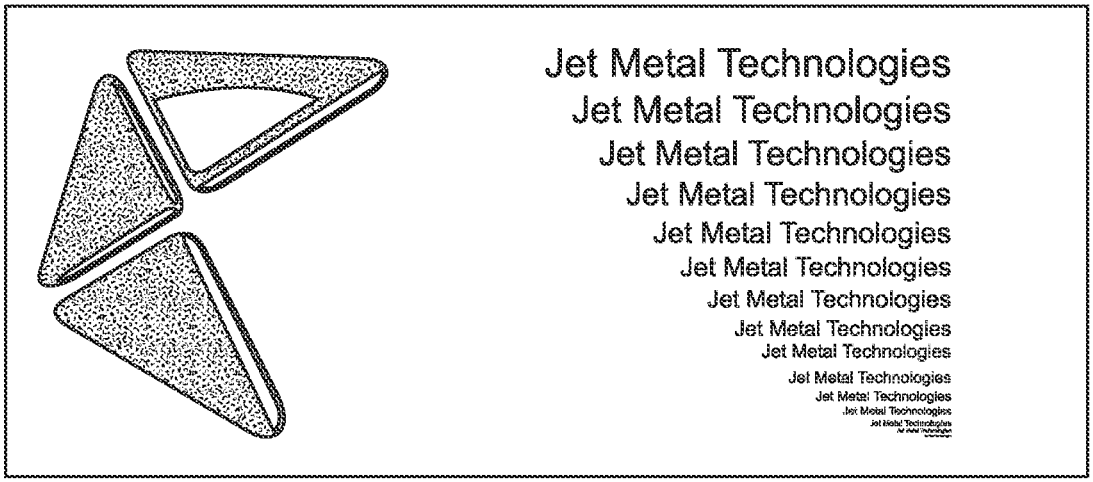

-B-Deposition of a Temporary Protection:

A film of quick-drying alkali-soluble product, Propaco SC marketed by the company SOCOMORE, containing an alkali-soluble binder, is affixed onto the varnished plate through a screen printing mask corresponding to the negative of the metallic pattern to be produced. This mask is shown in the attached FIG. 3. The lightest areas allow the alkali-soluble product/ink intended to form the temporary protection to pass through.

-I-Treatment to Increase the Surface Energy:

Flame treatment via quick passes for a total duration of 5 s using a flame spray gun the flame temperature of which was adjusted to 1400° C. (After flame treatment, the substrate must have a surface energy greater than 50 dynes).

After the flame treatment step, the unprotected surface must be wetting in its entirety (the spraying of water onto the surface leads to the formation of a continuous liquid film).

-C-Activating/Sensitizing:

Spraying a sensitizing solution based on stannous chloride for 10 s using HVLP guns.

-K-Rinsing:

Rinsing the sensitizing solution by spraying demineralized water for 10 s using an HVLP gun.

-D-Metallization/-E-Eliminating the Temporary Protection:

Simultaneous spraying of an aqueous solution based on silver nitrate with a concentration of 2 g/L having an alkaline pH from 11.2+/−0.2 with an aqueous solution based on glucose for 40 s using HVLP guns.

The metallization takes place on the non-inked areas

The ink film is evacuated on contact with the metallization solutions

-F-Rinsing:

Rinsing with demineralized water for 10 s by spraying using an HVLP gun.

-G-Drying/Blowing:

Drying/Blowing by alternating pulsed compressed air at 5 bars at ambient temperature -H-Finishing The plate thus metallized is varnished by spraying using an HVLP gun and a varnish reference VM112 developed by the company Jet Metal Technologies®.

The plate undergoes desolvation in an oven at 60° C. for 5 minutes before polymerization in a UV enclosure (0.7 to 1.2 J/cm$^2$ UVA).

Figure 4:
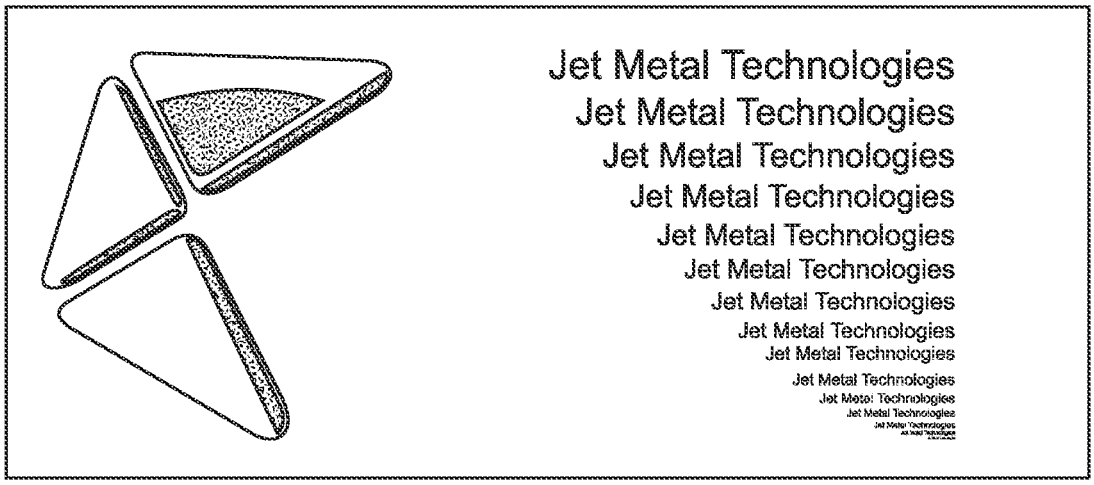
FIG. 4 shows the metal patterns obtained in Example 1.
Figure 4:
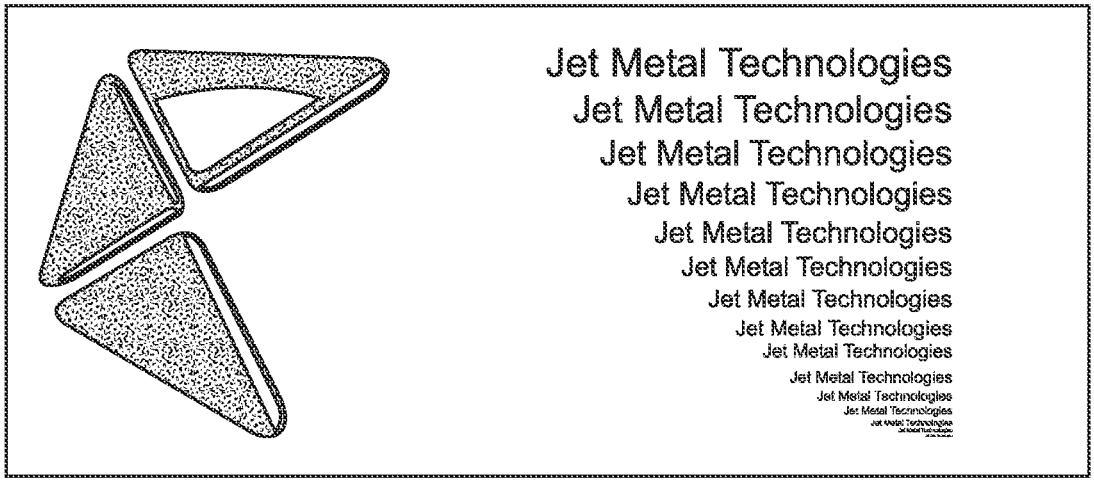

Metallic silver patterns are thus obtained corresponding to the negative of the ink initially deposited—see FIG. 4 attached. (The non-metallized parts correspond to the areas covered by the screen printing ink).

EXAMPLE 2

Producing an Electronic Pattern on a Rigid Polymer Substrate

Figure 5:
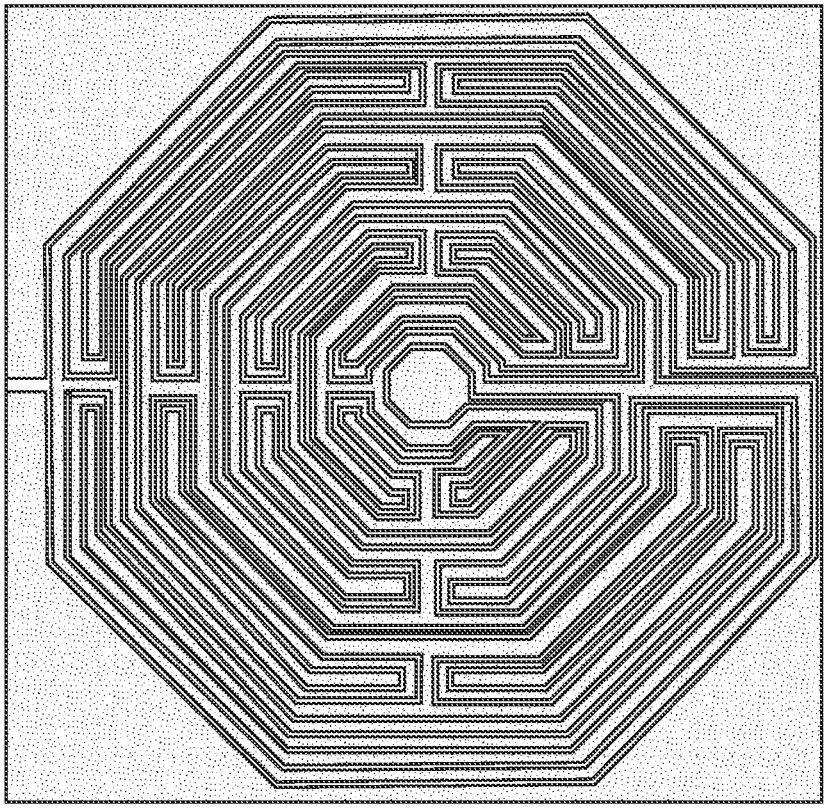
FIG. 5 shows the screen printing mask of Example 2.

-B-Deposition of a Temporary Protection:

A film of quick-drying alkali-soluble product, Propaco SC marketed by the company SOCOMORE, containing an alkali-soluble binder, is affixed onto an ABS plate of dimensions 25 cm×20 cm through a screen printing mask corresponding to the negative of the metallic pattern to be produced. This mask is shown in the attached FIG. 5, in which the lightest areas allow the alkali-soluble product/ink intended to form the temporary protection to pass through.

-I-Treatment to Increase the Surface Energy:

Flame treatment of the surface is earned out via quick passes for a total duration of 5 s using a flame spray gun the flame temperature of which was adjusted to 1400° C. (After flame treatment, the substrate must have a surface energy greater than 50 dynes).

After the flame treatment step, the unprotected surface must be wetting in its entirety (spraying of water onto the surface leads to the formation of a continuous liquid film).

-C-Activating/Sensitizing:

Spraying a sensitizing solution based on stannous chloride for 10 s using HVLP guns.

-K-Rinsing:

Rinsing with demineralized water for 10 s by spraying using an HVLP gun.

-D-Metallization/-E-Eliminating the Temporary Protection:

Simultaneous spraying of an aqueous solution based on silver nitrate with a concentration of 2 g/L having an alkaline pH from 11.5+/−0.2 with an aqueous solution based on glucose for 23 s using HVLP guns.

The metallization takes place on the eon-inked areas

The ink film is evacuated on contact with the metallization solutions

-F-Rinsing:

Rinsing with demineralized water for 10 s by spraying using an HVLP gun.

-G-Drying/Blowing:

Drying by alternating pulsed compressed air at 5 bars at ambient temperature

Figure 6:
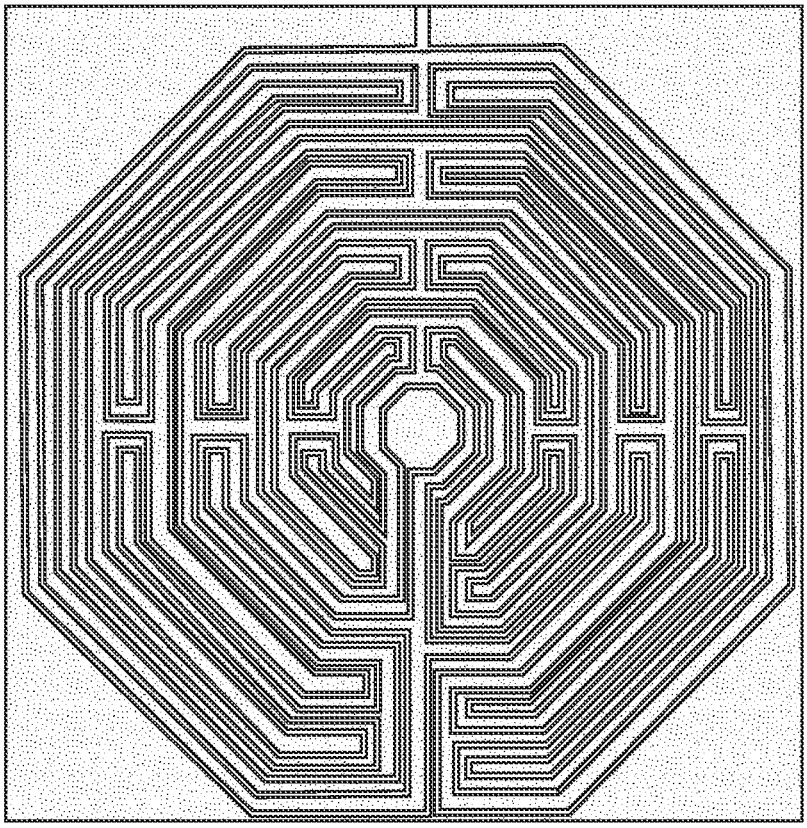
FIG. 6 shows the metal patterns obtained in Example 2.

A conductive circuit is thus obtained corresponding to the negative of the ink initially deposited—see FIG. 6 attached. (The non-metallized parts correspond to the areas coveted by the screen printing ink).

The silver deposit is sufficiently conductive to produce as electrolytic thickening With copper with a conventional copper acid bath based on copper sulphate and sulphuric acid.

EXAMPLE 3

Producing Decorative Metal Patterns In-Line by Inkjet Printing

The item made from polypropylene plastic (cylinder of 2.5 cm diameter and 8 cm high) is fixed on the conveyor upside down.

The conveyor is set in motion at a constant speed of 3 m/min and the item is rotated at 350rpm.

-A-Surface Preparation:

The item is degreased by rubbing with isopropanol alcohol, then a UV-cross-linking varnish, reference VB330R containing a 3% red colorant content from the company Jet Metal Technologies is affixed, by means of 3 HVLP guns. The PP item is moved into a heat oven at 50° for a desolvatation step for 4 minutes, then enters a UV oven in which the surface of the item is irradiated with a power of 0.9 J/cm$^2$.

-I-Treatment to Increase the Surface Energy:

Flame treatment of the rotating item is earned out on the conveyor via quick passes for a total duration of 5 s using a flame spray gun the flame temperature of which was adjusted to 1400° C. (After flame treatment, the subs tune must have a surface energy greater than 50 dynes).

After the flame treatment step, the unprotected surface must be wetting in its entirety (spraying of water onto the surface leads to the formation of a continuous liquid film).

-B-Deposition of a Temporary Protection:

Inkjet printing by means of a Ricoh Gen4 printing head by using an alkali-sensitive TIGER ink reference Heavy Duty Ink containing an alkali-sensitive binder is carded out on the rotating item in-line (without unloading the item from the conveyor). This ink is cross-linked by UV exposure by means of a mercury bulb the power of which is 40 mJ/cm$^2$.

This printing corresponds to the negative of the desired pattern.

The film-forming agent contained in the ink ensures masking of the surface; pigments are not essential for the correct operation of the process.

-C-Activating/Sensitizing:

Spraying a sensitizing solution based on stannous chloride for 5 s using HVLP guns.

-K-Rinsing:

Rinsing the sensitizing solution by spraying demineralized water for 10 s using an HVLP gun.

-D-Metallization

Simultaneous spraying of an aqueous solution based on silver nitrate with a concentration of 2 g/L having an alkaline pH from 11.2+/−0.2 with an aqueous solution based on glucose for 20 s using HVLP guns.

The metallization takes place on the non-inked areas

The adhesion of the alkali-sensitive ink film takes place on contact with the solutions during metallization.

-F-Rinsing/-E-Eliminating the Temporary Protection:

Rinsing with demineralized water for 20 s by spraying using HVLP guns.

The ink the adhesion of which was affected during the metallization step is evacuated during this rinsing.

-G-Drying:

Drying by alternating pulsed compressed air at 5 bars at ambient temperature using an air blade.

-H-Finishing:

The plate thus metallized is varnished by spraying using an HVLP gun and a varnish reference VM112 developed by the company Jet Metal Technologies®.

The plate undergoes desolvation in an oven at 60° C. for 5 minutes before polymerization in a UV enclosure (0.7 to 1.2 J/cm$^2$ UVA).

Mirror-effect metallic silver decorative patterns are thus obtained corresponding to the negative of the ink initially deposited. The non-metallized areas allow the colour of the red base varnish to appear. Pictogram characters can be produced in order to allow the name of a trade mark or a logo to appear.

EXAMPLE 4

Producing a Silver Pattern with Electrolytic Thickening with Copper In-Line

-B-Deposition of a Temporary Protection:

A quick-drying alkali-soluble ink film LINX, reference I070, is affixed by inkjet spraying (Seiko head) onto a flexible polyamide film 75 μm thick placed flat on a conveyor equipped with a winder/unwinder.

The inked pattern corresponds to the negative of the pattern to be produced.

-I-Treatment to Increase the Surface Energy:

In order to confer an increased adhesion of the metallic deposit with the substrate, an atmospheric plasma pretreatment (rotary plasma head) was applied (after plasma treatment, the substrate must have a surface energy greater than 50 dynes).

After the flame treatment step, the surface must be wetting in its entirety (spraying of water onto the surface leads to the formation of a continuous liquid film).

-C-Activating/Sensitizing:

Spraying a sensitizing solution based on stannous chloride for 5 s using HVLP guns.

-K-Rinsing:

Rinsing the sensitizing solution by spraying demineralized water for 10 s using an HVLP gun.

-D-Metallization/-E-Eliminating the Temporary Protection:

Simultaneous spraying of an aqueous solution based on silver nitrate with a concentration of 2 g/L having an alkaline pH from 11.2+/−0.2 with an aqueous solution based on glucose for 20 s using HVLP guns.

The metallization takes place on the non-inked areas

The ink film is solubilized and evacuated during the metallization on contact with the solutions -F-Rinsing:

Rinsing with demineralized water for 10 s by spraying using an HVLP gun.

-H-Finishing

The film with silvered pattern is then guided by the conveyor to a tank containing an acid copper bath based on copper sulphate and sulphuric acid at 20° C. in order to undergo an electrolytic copper thickening of 10 μm.

The polyamide film is linked on one of the silvered areas to a cathode contact placed opposite the soluble copper anodes.

A current density of $3A/dm^2$ makes it possible to produce a copper deposit of 10 μm in 20 minutes.

-F-Rinsing:

Demineralized water rinsing by immersion for 30 s.

-G-Drying:

Drying by alternating pulsed compressed air at 5 bars at ambient temperature

Throughout the entire process, the polyamide film is unrolled at the start of treatment, undergoes each step, then is re-rolled at the end of the process.

The invention claimed is:

1. Process for producing metal patterns on a substrate, consisting of the following steps:

A. optionally preparing the surface of the substrate intended to receive the metal patterns;

B. depositing a temporary protection on the surface of the substrate corresponding to a negative of the patterns to be produced by a screen printing mask/stencil the cut-outs of which correspond to the negative of the patterns to be produced; and/or by direct printing;

C. optionally activating the surface of the substrate;

D. metallization by depositing at least one metal on the areas corresponding to the patterns to be produced;

E. eliminating the temporary protection of step B;

F. optionally rinsing the surface of the substrate carrying the metal patterns;

G. optionally drying the surface of the substrate carrying the metal patterns;

H. optionally performing a finishing treatment on the surface of the substrate carrying the metal patterns;

wherein step E of eliminating the temporary protection is carried out, during step D, or at least partly during step D and after step D, or at least partly during and after the metallization step D and partly before the metallization step D;

wherein step E consists essentially in dissolving the temporary protection with at least one solvent contained in at least one of the liquids utilized for the metallization step D;

wherein the metallic deposition step D is a non-electrolytic metallization which consists of spraying of one or more redox solutions in the form of (an) aerosol(s) according to one of the following two methods:

a. simultaneously spraying one or more solutions of metallic cations and one or more solutions of reducing agents in a continuous manner; or b. separately spraying one solution of one or more metallic cations, and then spraying one solution of one or more reducing agents;

and wherein said process optionally comprises, before the metallization D, at least one of the following steps:

I. treatment increasing the surface area of the substrate, when the process comprises an activating step C, a step I of increasing the surface energy of the substrate can optionally be provided before the activation C;

J. wetting the surface of the substrate;

K. rinsing the surface of the substrate.

2. Process according to claim 1, wherein the metal of step D is selected from the following group of metals:

silver, nickel, tin, iron, gold, cobalt, copper; oxides, alloys and combinations thereof.

3. Process according to claim 1, wherein said process includes step A, which comprises the deposition of at least one layer of varnish and/or the degreasing of the surface of the substrate intended to receive the metal patterns.

4. Process according to claim 1, wherein the treatment for increasing the surface energy of the substrate according to step I is selected from physical treatments, and/or chemical treatments, and combinations thereof.

5. Process according to claim 1, wherein the finishing treatment H is the production of one or more coats of varnish and/or an electrolytic thickening composed of one or more metals.

6. Process according to claim 1, wherein a solvent allowing dissolution of the temporary protection is contained in at least one of the liquids utilized for the metallization step D and in the liquids used in at least one rinsing step.

7. Process according to claim 1, wherein the metal patterns obtained are decorative and/or functional.

8. Process according to claim 1, wherein said process is implemented continuously/in-line on components of an industrial plant.

9. Process for the manufacture of objects comprising metal patterns, wherein it includes the process according to claim 1.

10. Process according to claim 1, wherein the process comprises an activating step C and a step I of increasing the surface energy of the substrate, said step I being performed before the activation C.

11. Process according to claim 1, wherein the temporary protection is alkali-soluble.

* * * * *